US005839674A

United States Patent [19]

Ellis

[11] Patent Number: 5,839,674

[45] Date of Patent: Nov. 24, 1998

[54] APPARATUS AND PROCESS FOR DECOMPRESSING BLOCKS OF PARTICULATE MATERIALS SUCH AS BLOCKS OF COMPRESSED HORTICULTURAL MATERIALS

[76] Inventor: C. Mitchell Ellis, 7461 Lott Rd., Wilmer, Ala. 36587

[21] Appl. No.: 795,512

[22] Filed: Feb. 5, 1997

[51] Int. Cl.[6] ..... B02C 19/00

[52] U.S. Cl. ..... 241/73; 241/284

[58] Field of Search ..... 241/26, 284, 73, 241/605, 186.3, 101.8, 243; 366/155.1

[56] References Cited

U.S. PATENT DOCUMENTS

| | | | |
|---|---|---|---|
| 319,311 | 6/1885 | Peters | 366/155.1 |
| 929,770 | 8/1909 | Lish | 241/243 |
| 1,047,970 | 12/1912 | Miller et al. | 241/73 |
| 1,825,261 | 9/1931 | Burns et al. | 241/101.8 |
| 2,991,948 | 7/1961 | Hummelen | 241/73 |
| 3,547,358 | 12/1970 | Anderson et al. | 241/73 |
| 3,865,319 | 2/1975 | Hoffman | 241/73 |
| 4,114,817 | 9/1978 | Harris | 241/73 |

*Primary Examiner*—Mark Rosenbaum
*Attorney, Agent, or Firm*—Nixon & Vanderhye P.C.

[57] ABSTRACT

Apparatus and process for breaking blocks of compressed particulate material (e.g., coconut coir, peat moss and the like) includes feeding blocks of compressed coconut coir into a confined breaking space, and breaking coconut coir from the blocks to form a loose mass of coconut coir by causing the blocks of compressed coconut coir to tumble against one another along a general figure-eight flow path. Most preferably, the blocks of compressed particulate material fed into the confined breaking space are brought into contact with a spirally oriented rotary breaking bar. The breaking bar is supported concentrically relative to a central axis by means of radially disposed support arms which carry generally triangular lift teeth. The action of the spiral breaking bar and lift teeth (if present) cause the blocks of compressed particulate material to tumble against one another in the confined chamber along a general figure-eight flow path. This continual collision of the blocks against one another during the figure-eight tumbling action thereby causes the particulate material to be broken from the blocks. The loose mass of particulate material which is broken from the blocks falls by gravity through a screen at the bottom of the confined breaking chamber where it may be collected and discharged.

10 Claims, 4 Drawing Sheets

APPARATUS AND PROCESS FOR DECOMPRESSING BLOCKS OF PARTICULATE MATERIALS SUCH AS BLOCKS OF COMPRESSED HORTICULTURAL MATERIALS

FIELD OF INVENTION

The present invention relates generally to apparatus and processes for breaking blocks of compressed particulate or granular materials so that such materials will then be in an uncompressed state.

BACKGROUND AND SUMMARY OF THE INVENTION

Compressed particulate materials are advantageous since they occupy less space as compared to same amount of materials in an uncompressed bulk state and therefore may be shipped in greater quantities. Furthermore, compressing particulate materials into blocks allows them to be more easily handled. However, one significant disadvantage of such compressed materials is that the blocks must typically must be broken apart in order for the particulate materials to be useful.

Recently, for example, coconut coir has been supplied to the horticultural industry as a soil additive due to its high water-retention properties. Bulk coconut coir typically is obtained in block form. However, the highly compressed coconut coir blocks are not readily frangible in a dry state. In order to decompress the coconut coir blocks, therefore, it is conventional practice in the horticultural industry to soak a relatively large quantity or mound of coconut coir blocks with water. Over time (e.g. within about 24 hours), the fibrous coconut coir in the blocks will absorb the water and physically expand in size. This natural expansion of the coconut coir will thus result in the block being decompressed. The now wet coconut coir is, however, more difficult to handle by conventional particle handling systems.

Thus, it would be highly beneficial if blocks of highly compressed particulate materials, such as coconut coir, peat moss or the like, could be decompressed in a dry state without substantially damaging the materials. It is towards fulfilling such a need that the present invention is directed.

Broadly, the present invention is embodied in apparatus and methods whereby blocks of compressed particulate materials may be broken (decompressed) without substantially damaging the materials so as to form a loose mass of the particulate materials. Moreover, such decompression according to the present invention may (but does not necessarily have to) be accomplished in a dry state. As such, the decompressed particulate material which is obtained according to the present invention may be easily handled by conventional bulk particulate handling systems (e.g., pneumatic or mechanical conveyance systems).

In a particularly preferred embodiment of the present invention, the blocks of compressed particulate material are fed into a confined breaking chamber or space and brought into contact with a spirally oriented rotary breaking bar. Most preferably, the breaking bar is supported concentrically relative to a central axis by means of radially disposed support arms which carry generally triangular lift teeth. The action of the spiral breaking bar and lift teeth (if present) cause the blocks of compressed particulate material to tumble against one another in the confined chamber along a general figure-eight flow path. This continual collision of the blocks against one another during the figure-eight tumbling action thereby causes the particulate material to be broken from the blocks. The loose mass of particulate material which is broken from the blocks falls by gravity through a screen at the bottom of the confined breaking chamber where it may be collected and discharged.

These and other aspects and advantages of the present invention will become more clear to the reader after careful consideration is given to the following detailed description of the preferred embodiments thereof.

BRIEF DESCRIPTION OF THE ACCOMPANYING DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
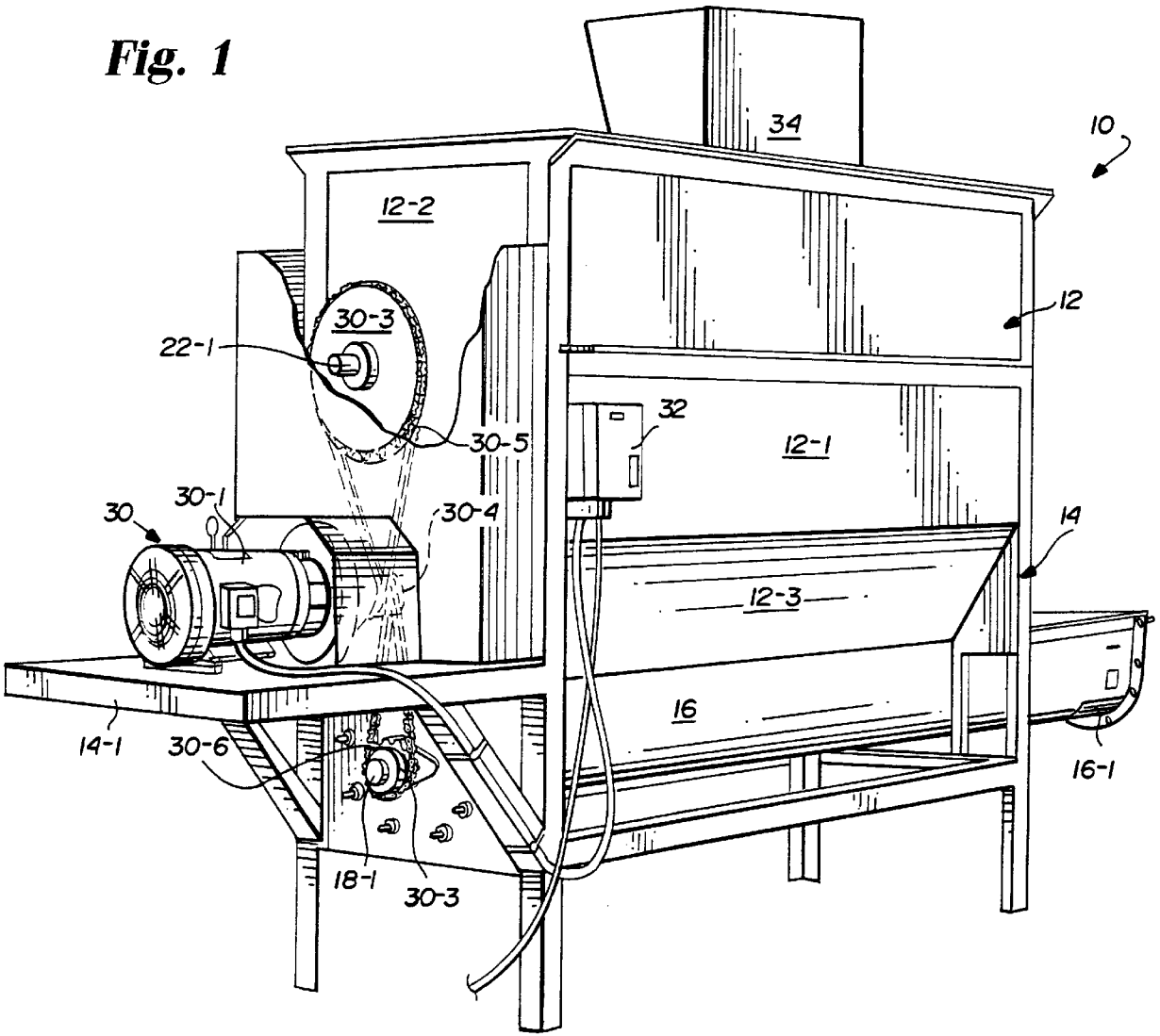
FIG. 1 is a perspective view of a preferred apparatus for decompressing blocks of compressed particulate materials according to the present invention.
Figure 2:
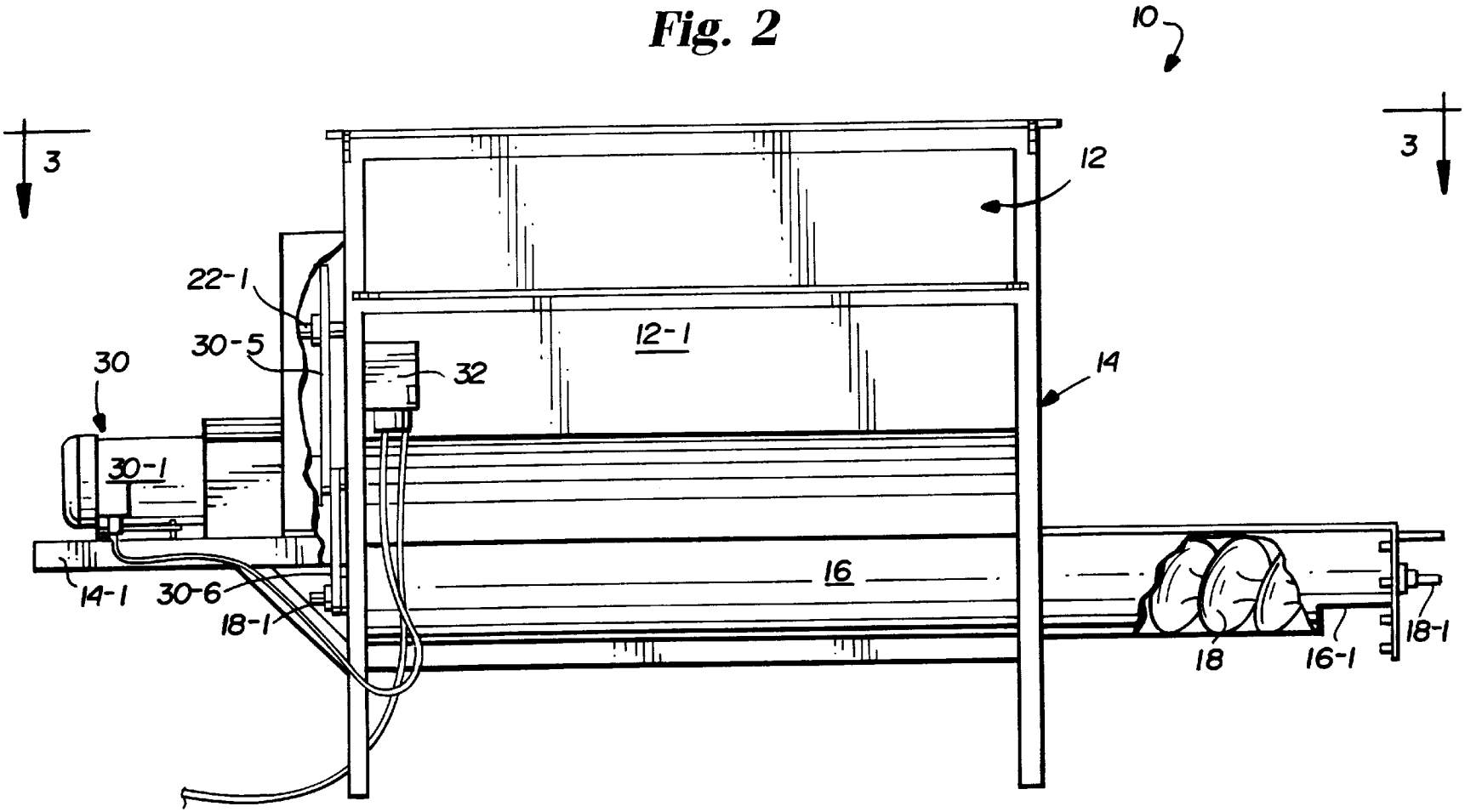
FIG. 2 is a side elevational view of the apparatus depicted in FIG. 1, but with the feed hopper and its associated cover removed.
Figure 3:
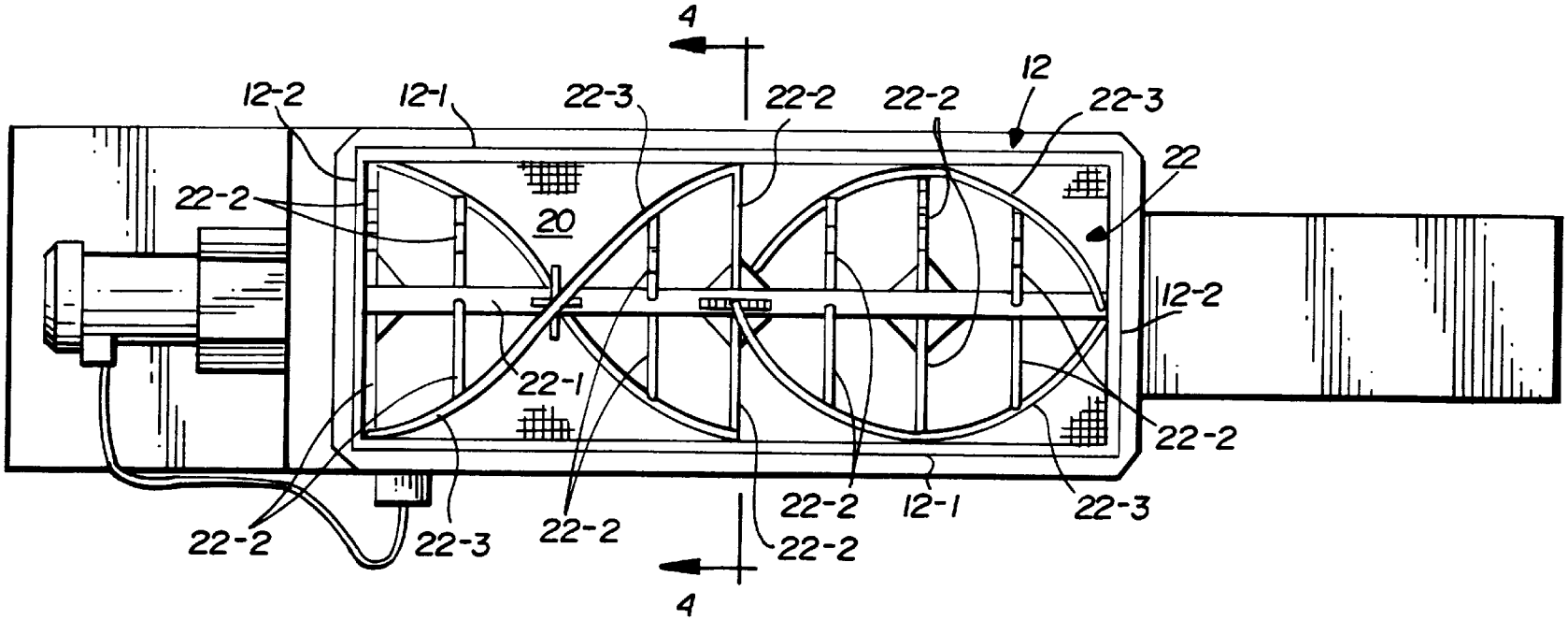
FIG. 3 is a top plan view of the apparatus depicted in FIG. 2 as taken along line 2—2 therein.
Figure 4:
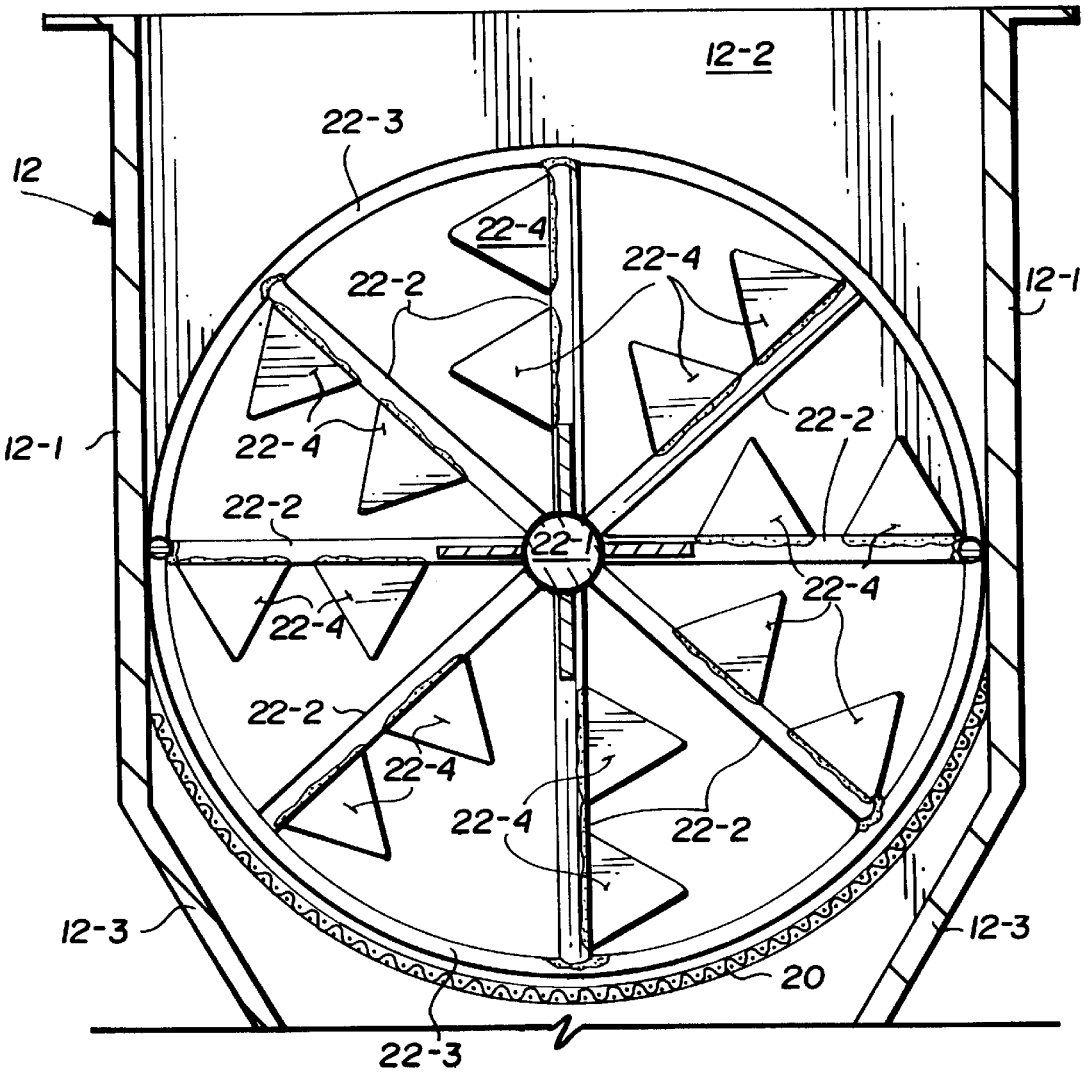
FIG. 4 is an enlarged cross-sectional view of the apparatus depicted in FIG. 3 as taken along line 4—4 therein.

As shown in accompanying FIGS. 1–4, the apparatus 10 of this invention generally includes a breaking chamber 12 formed from opposed pairs of side and end walls 12-1 and 12-2, respectively, and a pair of inwardly and downwardly inclined bottom walls 12-3 (only one such wall 12-3 being visible in the accompanying FIGS. 1–3, but see FIG. 4). The breaking chamber 12 is supported above the ground by means of a frame assembly 14.

The bottom walls 12-3 of the chamber 12 join an elongate discharge chute 16 which extends outwardly from one end of the apparatus 10. The discharge chute houses an auger screw 18 (see FIG. 2) which serves to convey decompressed particulate materials from the bottom of the breaking chamber 12 to a discharge opening 16-1 formed near the terminal end of the discharge chute 16.

The breaking chamber 12 houses an arcuate screen 20 positioned below and in close proximity to (e.g, about ⅛" spacing) a rotary breaker assembly 22 (see FIGS. 3 and 4). The screen is sized so as to allow particulate material broken from the blocks of compressed material to pass therethrough to the discharge chute 16, while supporting the blocks during the breaking operation. For example, for coconut coir, the mesh openings of the screen 20 will be larger than about 6 mm to 12 mm (i.e., larger than the nominal average size of the coconut coir) to allow the coconut coir particles to pass therethrough.

The rotary breaker assembly 22 includes a central axle 22-1 which is supported between the end walls 12-2 by suitable bearings (not shown). Radially opposed pairs of support arms 22-2 are rigidly joined at one end to the central axle 22. Each pair of support arm 22-2 is angularly off-set relative to an adjacent pair or pairs of support arms 22-2 by about 45° about the axis of the central axle 22-1 (see FIG. 4). The other ends of the support arms 22-2 are rigidly attached to a respective one of a spiraling breaker bar 22-3.

Each of the support arms 22-2 also carries pair of generally triangularly shaped lift teeth 22-4 oriented in the rotation direction of the breaker assembly 22 (which in the embodiment depicted just happens to a counter-clockwise direction as viewed in FIG. 4).

A drive assembly 30 is positioned adjacent an end wall 12-2 opposite to the discharge opening 16-1 of the discharge chute 16. The drive assembly 30 is generally comprised of an electric motor 30-1 which is supported by the platform support 14-1 associated with the frame assembly 14 and a pair of drive sprockets 30-2 and 30-3 operatively connected to the central axle 22-1 of the breaker assembly 22 and the central axle 18-1 of the auger screw 18, respectively. The drive sprockets 30-2 and 30-3 are respectively coupled to the output shaft and sprockets 30-4 of the drive motor 30-1 by means of drive chains 30-5 and 30-6, respectively. Operation of the motor 30-1 thereby causes the breaker assembly 22 and the auger screw to rotate concurrently with one another but at different rotation speeds as determined by the size of the drive sprockets 30-2 and 30-3, respectively.

In use, the motor 30-1 will be activated by an operator moving the switch contained in motor control box 32 into an "on" state thereby causing the breaker assembly 22 and the auger screw 18 to rotate concurrently with one another. Blocks of compressed particulate material (e.g., compressed coconut coir) may then be introduced into the interior space of the breaking chamber 12 through feed hopper 34 (see FIG. 1). The blocks of compressed particulate material will be encouraged to move in a generally "figure-8" manner by virtue of the spiraled breaker bars 22-3. More specifically, the blocks are caused to move along the screen 20 in a spiral manner. However, the lift teeth 22-4 lift the blocks above the screen 20 causing the blocks to continually tumble against one another while circulating in a general figure-8 flow pattern. This continual tumbling of one dry block against another causes the particulate material to break off and fall through the screen where it is collected in the discharge chute 16 and transferred by the auger screw 18 to the discharge opening 16-1. The particulate material may then be conveyed in any suitable manner to a storage site.

The apparatus and method described above is especially well suited for breaking blocks of compressed coconut coir since the tumbling action causes the coconut coir to be decompressed without damaging the coconut coir fiber. Furthermore, since the block of coconut coir can be decompressed in a dry state, the resulting coconut coir pith may be conveyed more conveniently by conventional particulate bulk handling systems.

The specific coconut coir blocks that may be processed according to the present invention is not critical. By way of example, however, one type of coconut coir block that may be satisfactorily decompressed by the present invention is commercially available from the Wessex Company under the registered trademark COCOPEAT®. In general, the blocks of coconut coir will be formed entirely of coconut coir fibers which have been compressed to a ratio of 5:1 with the individual coconut coir fibers having a nominal length of between about 6 mm to about 12 mm and will have a moisture content of between about 12–15%.

Although blocks of compressed coconut coir have been discussed above, the present invention may also be used to break apart blocks of other horticultural and/or non-horticultural particulate materials, such as peat moss blocks. Coconut coir blocks as discussed herein represent a particularly preferred embodiment of this invention and should be considered non-limiting with respect to the same.

Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for breaking blocks of compressed particulate material comprising:

a breaking chamber in which blocks of compressed particulate material are broken to form an uncompressed mass of the particulate material;

a rotary breaker disposed in the breaking chamber to cause the blocks to tumble against one another therewithin and thereby form the uncompressed mass of particulate material; and a screen disposed in said breaking chamber below said rotary breaker to allow said uncompressed mass of particulate material to pass therethrough, wherein said rotary breaker includes, (i) a central axle, (ii) at least one spirally oriented breaker bar concentrically disposed relative to said central axle, (iii) support arms radially extending from said central axle and rigidly interconnecting said central axle and said spirally oriented breaker bar, and (iv) generally triangularly shaped lift teeth associated with said support arms and oriented in the direction of rotation of said rotary beaker.

2. Apparatus as in claim 1, further comprising a discharge chute disposed below said breaker chamber for receiving said mass of particulate material which passes through said screen.

3. Apparatus as in claim 2, wherein said discharge chute includes a discharge opening, and a conveyor for moving said mass of particulate material in said discharge chute toward said discharge opening.

4. Apparatus as in claim 3, wherein said conveyor is a rotary auger screw.

5. Apparatus as in claim 4, further comprising a motor drive assembly having an electric motor and a drive shaft, said drive shaft being connected operatively to both said rotary breaker and auger screw whereby said rotary breaker and auger screw are simultaneously rotated in response to operation of said electric motor.

6. Apparatus for breaking blocks of compressed particulate material comprising:

a breaking chamber for receiving the blocks of compressed particulate material;

a discharge chute positioned at the bottom of said breaking chamber to receive particulate material which is broken from the blocks in the breaking chamber;

an arcuate screen positioned between said breaking chamber and said discharge chute to allow the particulate material which is broken from the blocks in the breaking chamber to pass therethrough; and a rotary breaker disposed in said breaking chamber above said screen, said rotary breaker including an opposed pair of spiral breaking bars; wherein said rotary breaker includes a central axle, and pairs of support arms radially extending from said central axle, said support arms being rigidly connected at one end thereof to said central axle and rigidly connected at another end thereof to a respective one of said spiral breaking bars; and wherein rotation of said spiral breaking bars in a selected rotation direction causes the blocks of compressed particulate material in the breaking chamber to move generally along a figure-eight flow path therewithin so that the blocks tumble against one another to break the particulate material therefrom.

7. Apparatus as in claim 6, wherein said support arms include generally triangularly shaped lift teeth oriented in said selected rotation direction to assist the blocks of compressed particulate material to move along the generally figure-eight flow path.

8. Apparatus as in claim 6, wherein said discharge chute includes a discharge opening, and a conveyor for moving the particulate material in said discharge chute toward said discharge opening.

9. Apparatus as in claim 8, wherein said conveyor is a rotary auger screw.

10. Apparatus as in claim 9, further comprising a motor drive assembly having an electric motor and a drive shaft, said drive shaft being connected operatively to both said rotary breaker and said auger screw whereby said rotary breaker and said auger screw are simultaneously rotated in response to operation of said electric motor.

* * * * *